US007107682B2

(12) United States Patent
Hauger

(10) Patent No.: US 7,107,682 B2
(45) Date of Patent: Sep. 19, 2006

(54) METHOD FOR MANUFACTURING TUBES AND PROFILES

(75) Inventor: Andreas Hauger, Attendorn (DE)

(73) Assignee: Muhr und Bender KG, Attendorn (DE)

( * ) Notice: Subject to any disclaimer, the term of this patent is extended or adjusted under 35 U.S.C. 154(b) by 179 days.

(21) Appl. No.: 10/852,036

(22) Filed: May 24, 2004

(65) Prior Publication Data

US 2005/0015959 A1 Jan. 27, 2005

(30) Foreign Application Priority Data

May 22, 2003 (DE) ..... 103 23 694

(51) Int. Cl.

| | |
|---|---|
| ***B21C 37/06*** | (2006.01) |
| ***B21C 37/30*** | (2006.01) |
| ***B23P 11/00*** | (2006.01) |
| *B21D 53/88* | (2006.01) |

(52) U.S. Cl. ..... 29/897.2; 29/890.53; 29/412; 29/525.14; 72/367.1; 72/368; 72/370.1; 72/370.14; 72/370.15

(58) Field of Classification Search ..... 29/890.53, 29/412, 417, 525.14, 897.2; 72/367.1, 368, 72/370.1, 370.14, 370.15

See application file for complete search history.

(56) References Cited

U.S. PATENT DOCUMENTS

| | | | | |
|---|---|---|---|---|
| 2,444,463 | A * | 7/1948 | Nordquist | 413/1 |
| 3,124,872 | A * | 3/1964 | Nordquist | 29/413 |
| 4,232,813 | A * | 11/1980 | Eaton | 228/147 |
| 4,628,721 | A * | 12/1986 | Williamson | 72/96 |
| 4,660,754 | A * | 4/1987 | Byrd | 228/151 |
| 4,697,446 | A * | 10/1987 | Yamamoto et al. | 72/178 |
| 4,706,488 | A * | 11/1987 | Williamson | 72/96 |
| 4,796,797 | A * | 1/1989 | Nakako et al. | 228/144 |
| 5,005,395 | A * | 4/1991 | Yasumura et al. | 72/128 |
| 5,054,196 | A * | 10/1991 | Sakaya et al. | 29/890.32 |
| 6,131,431 | A * | 10/2000 | Ona | 72/176 |
| 6,212,925 | B1 * | 4/2001 | Wang et al. | 72/52 |
| 6,643,931 | B1 * | 11/2003 | Nees | 29/897.312 |
| 6,792,681 | B1 * | 9/2004 | Fader et al. | 29/897.2 |
| 2002/0138987 | A1 * | 10/2002 | Nees | 29/897.312 |

FOREIGN PATENT DOCUMENTS

| | | | |
|---|---|---|---|
| DE | 42 12 049 | C2 | 1/2004 |
| DE | 197 40 323 | A1 | 1/2004 |
| DE | 244 083 | A1 | 1/2004 |
| EP | 0 014 474 | A1 | 10/2004 |
| EP | 0 788 849 | A1 | 10/2004 |
| EP | 0 938 937 | A1 | 10/2004 |
| EP | 1 272 291 | B1 | 10/2004 |
| GB | 2222541 | A * | 3/1990 |

* cited by examiner

*Primary Examiner*—Jermie E. Cozart

(57) ABSTRACT

The invention relates to a method for manufacturing tubes and profiles with variable wall thickness over the length. The method comprises the steps of flexible rolling of continuous material strip with variable thickness in the longitudinal direction of the strip material to a final wall thickness which is continuously reduced with respect to the original wall thickness, reshaping the material strip to form a continuous tube or profile and cutting to length individual tube or profile pieces from the continuous tube or profile.

9 Claims, 1 Drawing Sheet

METHOD FOR MANUFACTURING TUBES AND PROFILES

The invention relates to a method for manufacturing tubes and profiles with variable wall thickness over the length thereof and a hydraulic internal pressure forming method.

BACKGROUND OF THE INVENTION

DE 104 875 teaches the roll out of flat or strip-shaped pieces of sheet metal such that parallel strips of different wall thickness are formed on the piece of sheet metal. Thereafter the piece of sheet metal is bent transverse to these strips and soldered to form a tube, whereby the tube has longitudinal sections of different wall thickness.

EP 0 788 849 A1 describes a similar method for manufacturing tubes having sections of different wall thickness in which regions of different wall thickness running parallel to one another are formed from initially flat sheet metal by specific partial reduction in wall thickness. In this case, the rolled sheet metal is cut to size, shaped into a tube and joined along the butting edges and welded.

DD 244 083 A1 describes a known method for the production of tubes and profiles having a variable inner diameter over the length. Herein defined portions of a metal strip are rolled, while other portions of the strip remain unrolled and thereby maintain their original wall thickness. The metal strip rolled that way is then formed to a tube or profile in a profiling apparatus.

The periodical change from rolled portions to unrolled portions limits the rolling speed and can weaken the strip at the regions of transition When the unrolled portions pass the rolling apparatus, there is no guiding of the metal strip. From this there is no exact measurement of length of the unrolled metal strip portions possible.

OBJECT OF THE INVENTION

The object of the present invention is to provide an improved method of manufacturing for tubes and profiles of the said type with raised productivity.

SUMMARY AND DETAILED DESCRIPTION OF THE METHOD OF THE INVENTION

The solution consists in a method comprising the steps according to the invention:

- Flexible rolling of continuous material strip with variable thickness in the longitudinal direction of the strip material to a final wall thickness which is continuously reduced with respect to the original wall thickness,
- Reshaping the material strip to form a continuous tube or profile,
- Cutting to length individual tube or profile pieces from the continuous tube or profile.

With this method, the technique of flexible rolling of continuous strip material, as described by the Applicant in the German Patent Application 103 15 357.8, is developed for the manufacture of tubes and profiles of said type for improved productivity.

In this case, it is fundamentally possible to adapt the rolling speed to the best possible reshaping speed for reshaping into a continuous tube or profile so that all the process steps can proceed synchronously. In a preferred embodiment of the process however, after the flexible rolling is carried out at high speed, the material strip is wound onto a coil at a first winding speed. For reshaping the material strip to form a continuous tube or profile, this coil is then unwound at a second lower winding speed which is optimized so that the reshaping forms a continuous tube or profile.

Installations for bending round in the longitudinal direction of the material strip or for reshaping to form a profile in the longitudinal direction of the material strip with a suitable roller arrangement with shaping rollers are known in the technology. Such installations comprise a pluralist of shaping rollers located one after the other in the production direction with regularly varying roller shape and/or axial position.

Tubes and profiles can comprise slotted tubes or profiles open in cross-section or tubes or profiles closed in cross-section. In a preferred embodiment of the method the continuous tube or profile is welded longitudinally to form a closed tube or profile.

According to a further advantageous embodiment of the method, the individual tube or profile pieces are reshaped to form variable cross-sections over the length. Such tube pieces may be used in motor vehicle construction in many intended uses, especially as supporting members having defined non-uniform deformation behavior (crash elements) or having defined non-uniform loading behavior (bending supports).

According to a particular embodiment of the method, tubes which are initially uniformly round over the length are reshaped such that at least one longitudinal section is out of round with a laterally flattened in cross-section.

With the flexible rolling method a steady transition between the individual portions is produced with respect to thickness. The original thickness may be continuously reduced by at least 5%. Strip portions of constant thickness adjoining one another preferably differ in the final wall thickness by at least 20%, and may differ by more than 25%. The regions of transition between individual strip portions of different constant final wall thickness should be expanded so that a gradient from change of wall thickness versus strip length of at least 1:40 is produced.

DETAILED DESCRIPTION OF THE TUBE OF THIS INVENTION ILLUSTRATED IN THE DRAWINGS

Figure 1:
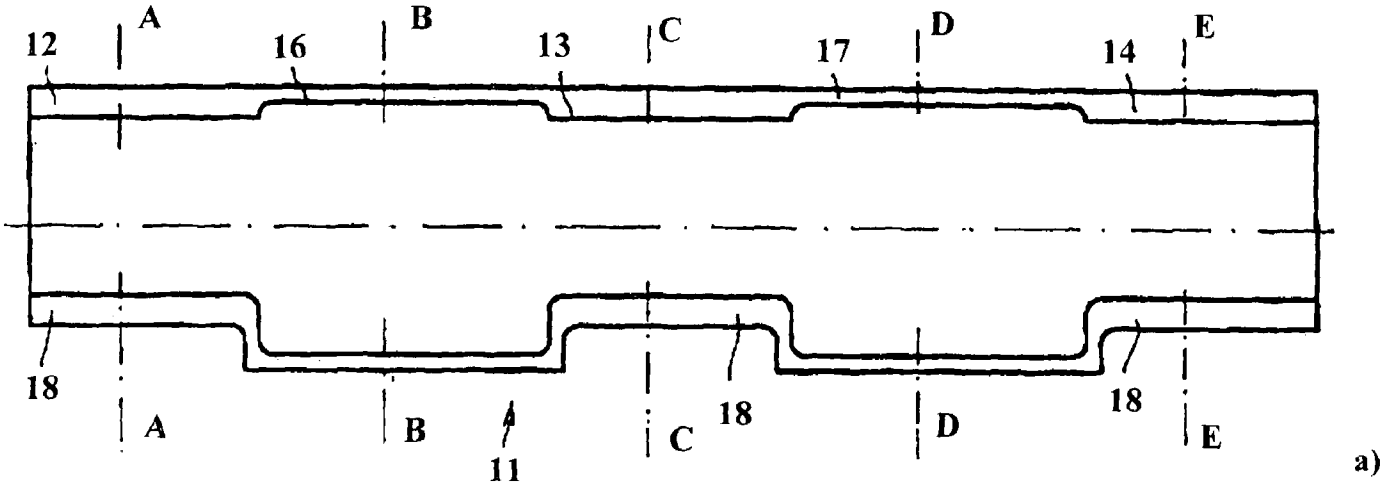
FIG. 1 shows a longitudinal cross-section view of an exemplary embodiment of a tube of this invention.
Figure 2:
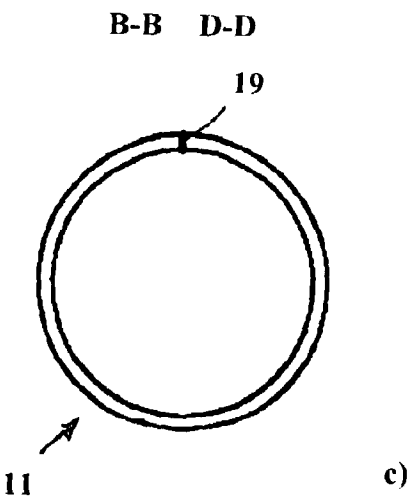
FIG. 2 shows a transverse cross-section view of a tube of this invention with one side flattened at B—B and D—D of FIG. 1.
Figure 3:
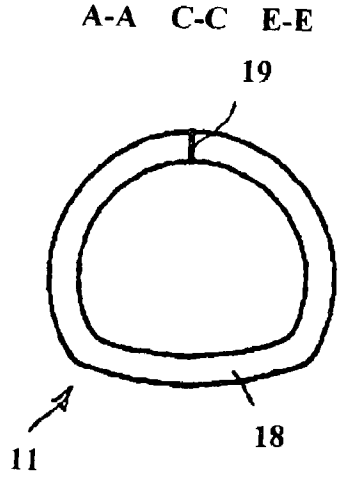
FIG. 3 shows a transverse cross-section view of the tube of this invention at A—A, C—C and E—E of FIG. 1.

The drawings illustrate a longitudinal section of a tube 11 according to the invention. First sections 12, 13 and 14 have a greater wall thickness and one-sided flattening 18. The intermediate two sections 16 and 17 have a smaller wall thickness and a non-deformed circular cross-section. Also marked is a longitudinal seam 19 which is not directly affected by the subsequent reshaping of the tube.

I claim:

1. A method for manufacturing tubes and profiles having variable wall thickness over the length, comprising the steps of:

flexible rolling of continuous material strip with variable thickness in the longitudinal direction of the strip material to a final wall thickness which is continuously reduced with respect to the original wall thickness, reshaping the material strip to form a continuous tube or profile, cutting to length individual tube or profile pieces from the continuous tube or profile, and wherein after said flexible rolling, said continuous material strip is wound onto a coil at a first winding speed and said continuous material strip is then unwound from said coil for reshaping the material strip at a second lower winding speed.

2. The method according to claim 1, wherein after said reshaping and before the cutting to length, said material strip is longitudinally welded to form a closed tube or profile.

3. The method according to claim 1, wherein after cutting to length, said individual tube or profile pieces are reshaped to form variable cross-sections over the length.

4. The method according to claim 1, wherein after cutting to length, said individual tube or profile pieces are reshaped to form variable cross-sections over the length, and wherein said reshaping takes place by a hydraulic internal pressure forming method.

5. The method according to claim 4, wherein said tube or piece initially uniformly round over the length is reshaped so that at least one longitudinal section is out of round flattened on one side.

6. The method according to claim 4, wherein said profile piece having an initially uniform cross-section over the length is reshaped so that at least one longitudinal section has a cross-section which differs therefrom.

7. The method according to claim 6, wherein by flexible rolling there is a reduction in all thickness continuously of at least 5%.

8. The method according to claim 7, wherein portions of the strip material adjoining one another differ in final wall thickness by at least 20% or more from each other.

9. The method according to claim 8, wherein in transition portions between portions of strip material of constant wall thickness there is a gradient of change of wall thickness versus strip length of at most 1:40.

* * * * *